US009631829B2

(12) United States Patent
Kaneko

(10) Patent No.: US 9,631,829 B2
(45) Date of Patent: Apr. 25, 2017

(54) AIR CONDITIONER

(71) Applicant: SAMSUNG ELECTRONICS CO., LTD., Suwon-si, Gyeonggi-do (KR)

(72) Inventor: Takashi Kaneko, Osaka (JP)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 355 days.

(21) Appl. No.: 14/361,937

(22) PCT Filed: Nov. 30, 2012

(86) PCT No.: PCT/JP2012/081163
§ 371 (c)(1),
(2) Date: May 30, 2014

(87) PCT Pub. No.: WO2013/081132
PCT Pub. Date: Jun. 6, 2013

(65) Prior Publication Data

US 2014/0358296 A1 Dec. 4, 2014

(30) Foreign Application Priority Data

Nov. 30, 2011 (JP) ..... 2011-262298

(51) Int. Cl.
*G01M 1/38* (2006.01)
*F24F 11/00* (2006.01)
*F25B 49/02* (2006.01)

(52) U.S. Cl.
CPC ..... *F24F 11/0009* (2013.01); *F24F 11/008* (2013.01); *F25B 49/022* (2013.01);
(Continued)

(58) Field of Classification Search
CPC .. F25B 13/00; F25B 2500/18; F25B 2600/02; F25B 2600/022; F25B 2600/027;
(Continued)

(56) References Cited

U.S. PATENT DOCUMENTS 4,633,672 A * 1/1987 Persem ..... F25B 49/022 307/39
6,637,222 B2 * 10/2003 Cho ..... F04C 27/005 62/157

(Continued)

FOREIGN PATENT DOCUMENTS

EP 2 351 973 8/2011
GB 2 287 783 2/1995

(Continued)

OTHER PUBLICATIONS

Chinese Notice of Allowance issued on Jan. 19, 2017 in corresponding Chinese Patent Application No. 201280068543.6.

(Continued)

*Primary Examiner* — Darrin Dunn
(74) *Attorney, Agent, or Firm* — Staas & Halsey LLP

(57) ABSTRACT

An air conditioner capable of achieving both user comfort and power reduction is provided. The air conditioner includes a mean room temperature sensing mechanism 13 for sensing the mean room temperature of an indoor space, a normal target pressure memory 14 storing a normal target pressure set to a target value during normal control operation of a compressor controller and related with the outdoor temperature and air-conditioning load of the indoor space, a normal temperature difference computation unit 15 for calculating a temperature difference between a normal saturation temperature corresponding to the normal target pressure and the mean room temperature as a normal temperature difference, and a power reduction temperature difference computation unit 16 for calculating a power reduction temperature difference reduced from the normal temperature difference on the basis of a target power consumption decrement with respect to power consumption during normal control of the air conditioner, a compressor controller 18 is configured to control a compressor 5 by changing a power (Continued)

reduction target pressure, which is a saturation pressure corresponding to a power reduction saturation temperature calculated on the basis of the mean room temperature and the power reduction temperature difference, to the target value.

5 Claims, 6 Drawing Sheets

(52) U.S. Cl.
CPC ... *F24F 11/0012* (2013.01); *F24F 2011/0047* (2013.01); *F25B 2500/19* (2013.01); *F25B 2700/2104* (2013.01); *F25B 2700/2106* (2013.01)

(58) Field of Classification Search
CPC ..... F25B 2700/21; F24F 2011/0094; Y02B 30/741; Y02B 30/743
See application file for complete search history.

(56) References Cited

U.S. PATENT DOCUMENTS

| | | | | |
|---|---|---|---|---|
| 6,779,356 | B2 * | 8/2004 | Lee | F25B 13/00 62/204 |
| 7,424,343 | B2 * | 9/2008 | Kates | F25B 49/005 62/126 |
| 8,287,230 | B2 * | 10/2012 | Hurst, Jr. | F04B 49/065 415/5 |
| 8,485,789 | B2 * | 7/2013 | Gu | F04C 18/0215 417/213 |
| 9,316,420 | B2 * | 4/2016 | Yamashita | F25B 25/005 |
| 9,353,979 | B2 * | 5/2016 | Morimoto | F24F 3/06 |
| 9,372,021 | B2 * | 6/2016 | Kato | F25B 49/02 |
| 2003/0018415 | A1 * | 1/2003 | Sonobe | F04B 27/1804 700/275 |
| 2009/0171512 | A1 * | 7/2009 | Duncan | F24F 5/0035 700/300 |
| 2011/0035062 | A1 * | 2/2011 | Nakayama | F25B 49/027 700/282 |
| 2011/0137468 | A1 * | 6/2011 | Duncan | F24F 5/0035 700/277 |
| 2011/0209487 | A1 * | 9/2011 | Tachiki | F24F 11/0086 62/129 |
| 2012/0210742 | A1 * | 8/2012 | Kato | F25B 13/00 62/159 |
| 2013/0319018 | A1 * | 12/2013 | Lim | F25B 49/022 62/56 |
| 2014/0069131 | A1 * | 3/2014 | Masui | F24F 11/0034 62/180 |
| 2014/0130532 | A1 * | 5/2014 | Chen | F25B 47/022 62/277 |
| 2014/0223940 | A1 * | 8/2014 | Morimoto | F25B 49/027 62/183 |

FOREIGN PATENT DOCUMENTS

| | | |
|---|---|---|
| JP | 7-190455 | 7/1995 |
| JP | 2006-329468 | 12/2006 |
| JP | 2007-255832 | 10/2007 |
| JP | 2011-7422 | 1/2011 |
| JP | 2011-144956 | 7/2011 |

OTHER PUBLICATIONS

European Office Action issued on Jan. 24, 2017 in corresponding European Patent Application No. 12 853 680.2.

* cited by examiner

AIR CONDITIONER

CROSS REFERENCE TO RELATED APPLICATIONS

This application is the U.S. national stage of International Application No. PCT/JP2012/081163, filed Nov. 30, 2012 and claims the benefit thereof. The International Application claims the benefits of Japanese Application No. 2011-262298 filed on Nov. 30, 2011, both applications are incorporated by reference herein in their entirety.

TECHNICAL FIELD

The present invention relates to an air conditioner having a function of reducing power consumption.

BACKGROUND ART

An air conditioner having a demand control function for reducing power consumption such that power consumption does not exceed a predetermined threshold value is known. A method of adjusting an expansion valve open degree according to an external demand command is known as a demand control method (refer to reference 1). This method reduces power consumption by controlling the quantity of refrigerant circulating in an air conditioning cycle. However, since the method cannot optimally control the air conditioning cycle according to air-conditioning load, power reduction effect is limited.

A method of controlling a compressor speed according to an external demand command is known as another demand control method (refer to reference 2). This method can improve COP by reducing the quantity of refrigerant circulating in an air conditioning cycle and increasing the efficiency of the air conditioning cycle. However, since the method cannot optimally control the air conditioning cycle according to air-conditioning load, power reduction effect is limited. Furthermore, this method may cause an air conditioner to operate at a cooling evaporation temperature/heating condensation temperature which damages comfort of a user environment.

RELATED ART REFERENCES

Patent References

Patent Reference 1: Japanese Patent Application Publication No. 1995-190455

Patent Reference 2: Japanese Patent Application Publication No. 2011-7422

DISCLOSURE

Technical Problem

The aforementioned conventional demand control uniformly deteriorates capability of the air conditioner when power consumption of the air conditioner exceeds a predetermined threshold value. Accordingly, capability of the air conditioner is maintained rather than being deteriorated as long as power consumption does not exceed the threshold value even if user comfort is not damaged, or the capability of the air conditioner is deteriorated if power consumption exceeds the threshold value even when user comfort is damaged. Therefore, the conventional demand control lacks concern for user comfort cannot achieve both user comfort and power reduction.

Therefore, the present invention has been made in view of the above problems, and it is an object of the present invention to provide an air conditioner capable of achieving both user comfort and power reduction.

Technical Solution

In accordance with an aspect of the present invention, the above and other objects can be accomplished by the provision of an air conditioner including an indoor unit and an outdoor unit, including: a mean room temperature sensing mechanism for sensing the mean room temperature of an indoor space in which the indoor unit is installed; a compressor contained in the outdoor unit; a compressor controller for controlling the compressor such that the pressure of a refrigerant discharged from the compressor or the pressure of a refrigerant sucked into the compressor becomes a target pressure value; a normal target pressure memory storing a normal target pressure set to a target value during normal control operation of the compressor controller and related with the outdoor temperature and air-conditioning load of the indoor space; a normal temperature difference computation unit for calculating a temperature difference between a normal saturation temperature corresponding to the normal target pressure and the mean room temperature as a normal temperature difference; and a power reduction temperature difference computation unit for calculating a power reduction temperature difference reduced from the normal temperature difference on the basis of a target power consumption decrement with respect to power consumption during normal control of the air conditioner, wherein the compressor controller is configured to control the compressor by changing a power reduction target pressure, which is a saturation pressure corresponding to a power reduction saturation temperature calculated on the basis of the mean room temperature and the power reduction temperature difference, to the target value. According to this configuration, based on the idea that capability of the air conditioner is wasted when user comfort is satisfied as the normal temperature difference (a temperature difference between the normal saturation temperature corresponding to the normal target pressure and the mean room temperature) increases, the normal temperature difference based on the target power consumption decrement is reduced in response to the magnitude of the normal temperature difference and the compressor is controlled using the power reduction target pressure based on the power reduction temperature difference reduced from the normal temperature difference, thereby setting the power reduction target pressure within the range within which user comfort can be maintained while securing power reduction effect at all times, compared to the conventional demand control scheme in which capability of the air conditioner is deteriorated only when power consumed by the air conditioner exceeds a predetermined threshold. Consequently, it is possible to enable power reduction without damaging user comfort, achieving both user comfort and power reduction.

In addition, the power reduction temperature difference computation unit may calculate the power reduction temperature difference by multiplying the normal temperature difference by a power reduction coefficient based on the target power reduction decrement in order to set power consumption with high accuracy for demands of the user and to prevent deterioration of user comfort due to excessive increase of the target power reduction decrement, which is estimated during conventional demand control.

Furthermore, the air conditioner may further include a target power consumption decrement change unit capable of changing the target power consumption decrement according to operation of a user to obtain an optimized power reduction target pressure corresponding to an air-conditioning load of the indoor space, thereby achieving maximum power reduction.

Moreover, the compressor controller may include a power reduction saturation temperature setting unit for setting a value obtained by subtracting a predetermined value from the mean room temperature to the upper limit of the power reduction saturation temperature in a cooling mode of the air conditioner and setting a value obtained by adding the predetermined value to the mean room temperature to the lower limit of the power reduction saturation temperature in a heating mode of the air conditioner in order to prevent lack of cooling/heating performance due to insufficient capability of the indoor unit.

In addition, the power reduction saturation temperature setting unit may set the predetermined value to a value in the range of 3° C. to 10° C. in order to prevent poor heat exchange in the indoor unit and comfort deterioration due to an insufficient temperature difference between the air and refrigerant, which is estimated in the conventional demand control operation and to prevent power reduction effect from being deteriorated due to unnecessary power reduction saturation temperature restriction.

Advantageous Effects

According to the air conditioner of the present invention, the normal temperature difference based on the target power consumption decrement is reduced in response to the magnitude of the normal temperature difference and the compressor is controlled using the power reduction target pressure based on the power reduction temperature difference reduced from the normal temperature difference, thereby setting the power reduction target pressure within the range within which user comfort can be maintained while securing power reduction effects at all times, compared to the conventional demand control scheme in which capability of the air conditioner is deteriorated only when power consumed by the air conditioner exceeds a predetermined threshold, based on the idea that capability of the air conditioner is wasted when user comfort is satisfied as the normal temperature difference (a temperature difference between the normal saturation temperature corresponding to the normal target pressure and the mean room temperature) increases. Consequently, it is possible to enable power reduction without damaging user comfort, achieving both user comfort and power reduction.

DESCRIPTION OF DRAWINGS

The above and other objects, features and other advantages of the present invention will be more clearly understood from the following detailed description taken in conjunction with the accompanying drawings, in which.

BEST MODE

An air conditioner according to an embodiment of the present invention will now be described with reference to FIGS. 1 to 5.

[Configuration of Air Conditioner 1]

Figure 1:
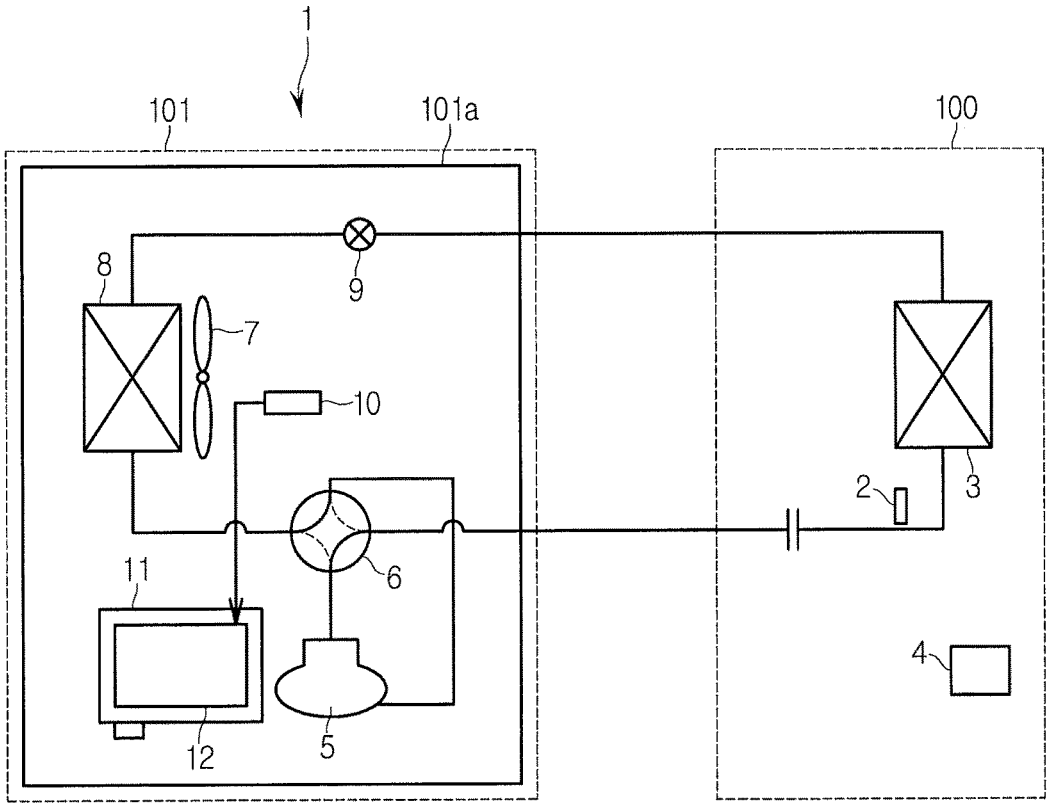
FIG. 1 illustrates a refrigerant circuit of an air conditioner according to the present invention.

FIG. 1 illustrates a refrigerant circuit of an air conditioner according to the present invention. Referring to FIG. 1, the air conditioner 1 includes an indoor unit 100 and an outdoor unit 101. While the air conditioner 1 according to the present embodiment is an air conditioner used in a wide indoor space such as an office in a building and includes an outdoor unit and a plurality of indoor units distributed in the indoor space, FIG. 1 shows only the representative indoor unit 100 from among the plurality of indoor units for convenience of description.

The indoor unit 100 includes a temperature sensor 2 for sensing the room temperature, an indoor heat exchanger 3 and a remote controller 4 for controlling the indoor unit 100 according to user manipulation.

The outdoor unit 101 includes a compressor 5, a four-way switching valve 6, an outdoor fan 7, an outdoor heat exchanger 8, an expansion valve 9 and an outdoor temperature sensor 10 for sensing outdoor temperature. The outdoor unit 101 includes an outdoor unit casing 101*a* for accommodating the compressor 5, the outdoor fan 7, the outdoor heat exchanger 8 and an electronics case 11. The electronics case 11 contains a control board provided with a control unit 12 for controlling the rotational speed of the compressor 5 and the open degree of the expansion valve 9 on the basis of information from each temperature sensor.

[Operation of Air Conditioner 1]

The air conditioner 1 can achieve cooling performance by switching the four-way switching valve 6 to a dotted line shown in FIG. 1 and achieve heating performance by switching the four-way switching valve 6 to a solid line shown in FIG. 1.

[Configuration of Control Unit 12]

Figure 2:
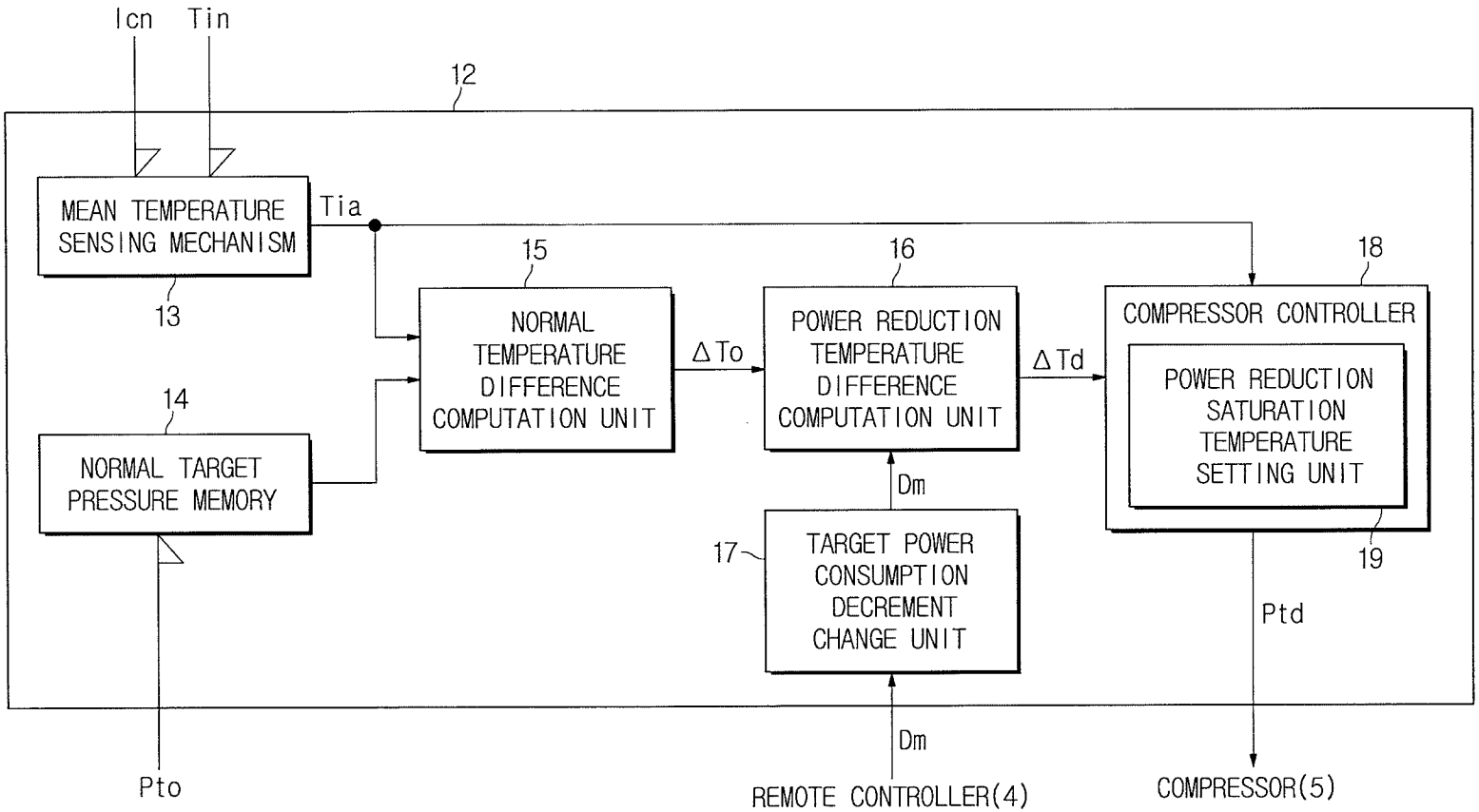
FIG. 2 is a block diagram of a controller.

FIG. 2 illustrates a configuration of the control unit 12. The control unit includes a control mechanism for accomplishing the purposes of the present invention, that is, user comfort and energy reduction. As shown in FIG. 2, the control unit 12 includes a mean room temperature sensing mechanism 13, a normal target pressure memory 14, a normal temperature difference computation unit 15, a power reduction temperature difference computation unit 16, a target power consumption decrement change unit 17 and a compressor controller 18.

The mean room temperature sensing mechanism 13 is configured to sense a weighted average (mean room temperature) Tia of the room temperature Tin sensed by the room temperature sensor 2 by inputting capacity (air-conditioning load) Icn of the indoor unit 100 and the room temperature Tin to the following equation 1. In the "capacity Icn" and "room temperature Tin" which are elements of Equation 1, n denotes an identification number of each indoor unit distributed in the indoor space.

Accordingly, the mean room temperature sensing mechanism 13 can sense the weighted average Tia of the room temperature Tin according to capacity Icn of an area corresponding to each indoor unit on the basis of Equation 1.

[Equation 1]

$$Tia=\Sigma(Tin\times Icn)/\Sigma(Icn) \quad (1)$$

The normal target pressure memory 14 is implemented as an EEPROM or flash memory capable of being electrically erased and programmed, for example, and is configured to store a normal target pressure set as a target value in normal control operation of the compressor controller 18. Here, the normal target pressure refers to pressure in relation with the outdoor temperature sensed by the outdoor temperature sensor 10 and indoor capacity Icn and is used as normal target suction pressure Pto in a cooling mode and used as normal target discharge pressure Pto in a heating mode.

The normal temperature difference computation unit 15 is configured to convert the normal target pressure (normal target suction pressure Pto/normal target discharge pressure Pto) pre-stored in the normal target pressure memory 14 into a normal saturation temperature (normal target suction pressure saturation temperature Tto/normal target discharge pressure saturation temperature Tto). Here, conversion can be performed using the following equation with respect to refrigerant properties, which can convert between property values (saturation pressure and saturation temperature) of a refrigerant.

[Equation 2]

$$Tto=f_1(Pto) \quad (2)$$

In addition, the normal temperature different computation unit 15 is configured to calculate a normal temperature difference ΔTo by inputting the normal target suction pressure saturation temperature Tto and the weighted average Tia sensed by the mean room temperature sensing mechanism 13 to the following equation (3) in the cooling mode. Similarly, the normal temperature difference computation unit 15 is configured to calculate a normal temperature difference ΔTo by inputting the normal target discharge pressure saturation temperature Tto and the weighted average Tia to the following equation (4) in the heating mode.

[Equation 3]

$$\Delta To=Tia-Tto \quad (3)$$

[Equation 4]

$$\Delta To=Tto-Tia \quad (4)$$

The power reduction temperature difference computation unit 16 is configured to calculate a demand temperature difference (temperature difference in case of power reduction) ΔTd reduced from the normal temperature difference ΔTo by inputting a target demand amount (target power consumption decrement) Dm, which is predetermined for power consumed during normal control of the air conditioner 1, and the normal temperature difference ΔTo calculated by the normal temperature difference computation unit 15 to the following equation (5). As can be known from the equation (5), the normal temperature difference ΔTo can be reduced by multiplying the normal temperature difference ΔTo by the target demand amount Dm. Accordingly, when the normal temperature difference ΔTo is 25° C. and the target demand amount Dm is 80, the demand temperature difference ΔTd obtained by calculation corresponds to 25×80/100=20.

[Equation 5]

$$\Delta Td=\Delta To\times Dm/100 \quad (5)$$

The target power consumption decrement change unit 17 is configured to change the target demand amount Dm according to manipulation of the remote controller 4 by a user. The target demand amount Dm can be set to values such as 50, 60, 70, 80, 90 and 100. That is, a power reduction coefficient (target demand amount Dm/100) can be set to a large value when user comfort is prioritized and set to a small value when power reduction is prioritized. Here, a minimum value of the power reduction coefficient is set to a value that does not damage comfort of a user environment based on evaluation of comfort. For example, when the user wants to secure satisfactory comfort, the minimum value of the power reduction coefficient is set to 0.5. A maximum of the power reduction coefficient is set based on power consumption decrease allowable error and set to 1.1 when an error of about 10% is permitted, for example.

The compressor controller 18 is configured to control the compressor 5 such that the pressure of the refrigerant sucked into the compressor 5 in the cooling mode or the pressure of the refrigerant discharged from the compressor 5 in the heating mode becomes a target value.

The compressor controller 18 is configured to calculate a demand saturation temperature (saturation temperature in case of power reduction) Ttd by inputting the weighted average Tia sensed by the mean room temperature sensing mechanism 13 and the demand temperature difference ΔTd calculated by the power reduction temperature difference computation unit 16 to the following equation (6) in the cooling mode. Similarly, the compressor controller 18 is configured to calculate the demand saturation temperature (saturation temperature in case of power reduction) Ttd by inputting the weighted average Tia and the demand temperature difference ΔTd to the following equation (7).

[Equation 6]

$$Ttd=Tia-\Delta Td \quad (6)$$

[Equation 7]

$$Ttd=Tia+\Delta Td \quad (7)$$

The compressor controller 18 is configured to calculate power reduction target pressure by inputting the demand saturation temperature Ttd to the following equation (8). Here, the power reduction target pressure is used for demand control of the compressor controller 18 as power reduction target suction pressure Ptd in the cooling mode and as power reduction target discharge pressure Ptd in the heating mode.

[Equation 8]

$$Ptd=f_2(Ttd) \quad (8)$$

The compressor controller 18 is configured to change the target value from the normal target pressure (normal target suction pressure Pto/normal target discharge pressure Pto) to the power reduction target pressure (power reduction target suction pressure Ptd/power reduction target discharge pressure Ptd) to control the compressor 5.

The compressor controller includes a power reduction saturation temperature setting unit 19 which can set a value, obtained by subtracting a predetermined value from the weighted average Tia, as the upper limit of the demand saturation temperature Ttd in the cooling mode and set a value, obtained by adding the predetermined value to the weighted average Tia, as the lower limit of the demand saturation temperature Ttd in the heating mode. In other words, the power reduction saturation temperature setting unit 19 can set the demand temperature difference ΔTd corresponding to the difference between the weighted average Tia and the demand saturation temperature Ttd to the predetermined value in the cooling mode. The power reduction saturation temperature setting unit 19 can set the demand temperature difference ΔTd corresponding to the difference between the demand saturation temperature Ttd and the weighted average Tia to the predetermined value in the heating mode. Here, the predetermined value can be set to a value in the range of 3° C. to 10° C. in order to avoid difficulty in heat exchange in the indoor unit 100 when a temperature difference between the air and refrigerant is lower than 3° C. and deterioration of power reduction effect due to sufficient heat exchange when the temperature difference exceeds 10° C. Accordingly, when the weighted average Tia is 25° C. and the predetermined value is 5° C. in the cooling mode, for example, the upper limit of the demand saturation temperature Ttd is set to 22° C. When the weighted average Tia is 20° C. and the predetermined value is 5° C. in the heating mode, for example, the lower limit of the demand saturation temperature Ttd is set to 25° C.

[Demand Control Operation According to the Present Embodiment]

A description will be given of examples of demand control operation in the cooling mode and the heating mode with reference to FIGS. 3 and 4. Operations illustrated in FIGS. 3 and 4 can be implemented by executing programs stored in an ROM by the control unit 12.

[Demand Control Operation in Cooling Mode]

Figure 3:
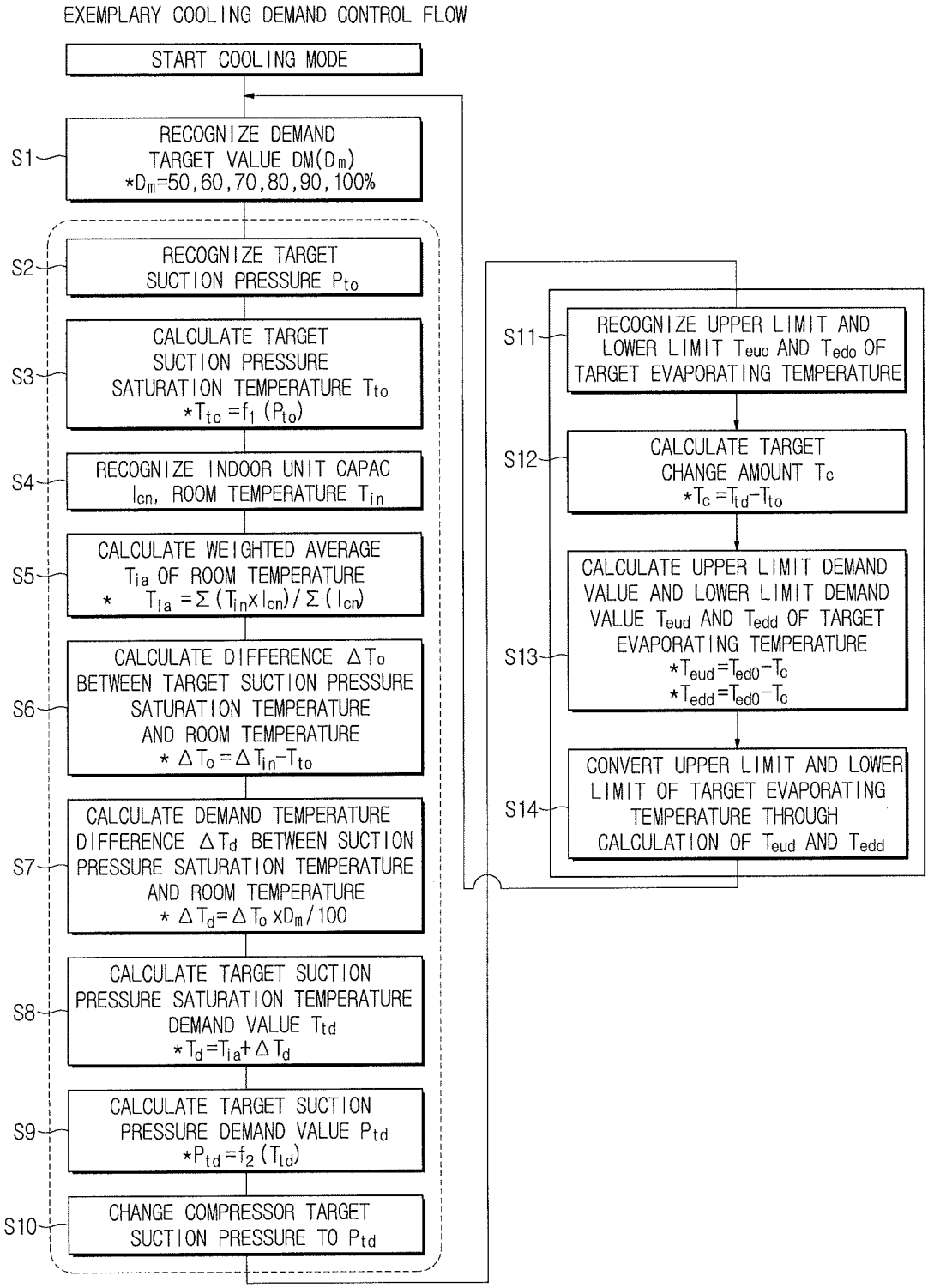
FIG. 3 is a flowchart illustrating an exemplary demand control operation in a cooling mode according to an embodiment of the present invention.

FIG. 3 is a flowchart illustrating an exemplary demand control operation in the cooling mode. In the demand control operation in the cooling mode, the predetermined target demand amount (target power consumption decrement) Dm is recognized in step S1.

The normal target suction pressure (normal target pressure) Pto pre-stored in the normal target pressure memory 14 is recognized in step S2.

The normal target suction pressure Pto is converted into the normal target suction pressure saturation temperature (normal saturation temperature) Tto using Equation (2) with respect to refrigerant properties in step S3.

Subsequently, capacity (air-conditioning load) Icn with respect to the indoor unit 100 and the room temperature Tin are recognized in step S4.

The weighted average (mean room temperature) Tia of the room temperature Tin is calculated using Equation (1) in step S5.

The normal temperature difference ΔTo is calculated using Equation (3) in step S6.

The demand temperature difference (temperature difference in case of power reduction) is calculated using Equation (5) in step S7.

The demand saturation temperature (saturation temperature in case of power reduction) Ttd is calculated using Equation (6) in step S8.

The power reduction target suction pressure Ptd is calculated using Equation (8) in step S9.

The target value in the compressor controller 18 is changed from the normal target suction pressure Pto to the power reduction target suction pressure Ptd in step S10.

The upper limit Teuo and lower limit Tedo of a target evaporating temperature are recognized in step S11.

A change amount Tc capable of changing the upper limit Teuo and lower limit Tedo of the target evaporating temperature is calculated by inputting the demand saturation temperature Ttd and the normal target saturation temperature Tto to the following equation (9) in step S12.

[Equation 9]

$$Tc=Ttd-Tto \tag{9}$$

An upper limit demand value Teud and a lower limit demand value Tedd of the target evaporating temperature are calculated by inputting the upper limit Teuo and the change amount Tc to the following equation (10) and inputting the lower limit Tedo and the change amount Tc to the following equation (11), respectively, in step S14.

[Equation 10]

$$Teud=Teuo+Tc \tag{10}$$

[Equation 11]

$$Tedd=Tedo+Te \tag{11}$$

After the upper limit Teuo and the lower limit Tedo of the target evaporating temperature are respectively converted into the upper limit demand value Teud and the lower limit demand value Tedd in step S14, the procedure is returned to step S1.

[Demand Control Operation in Heating Mode]

Figure 4:
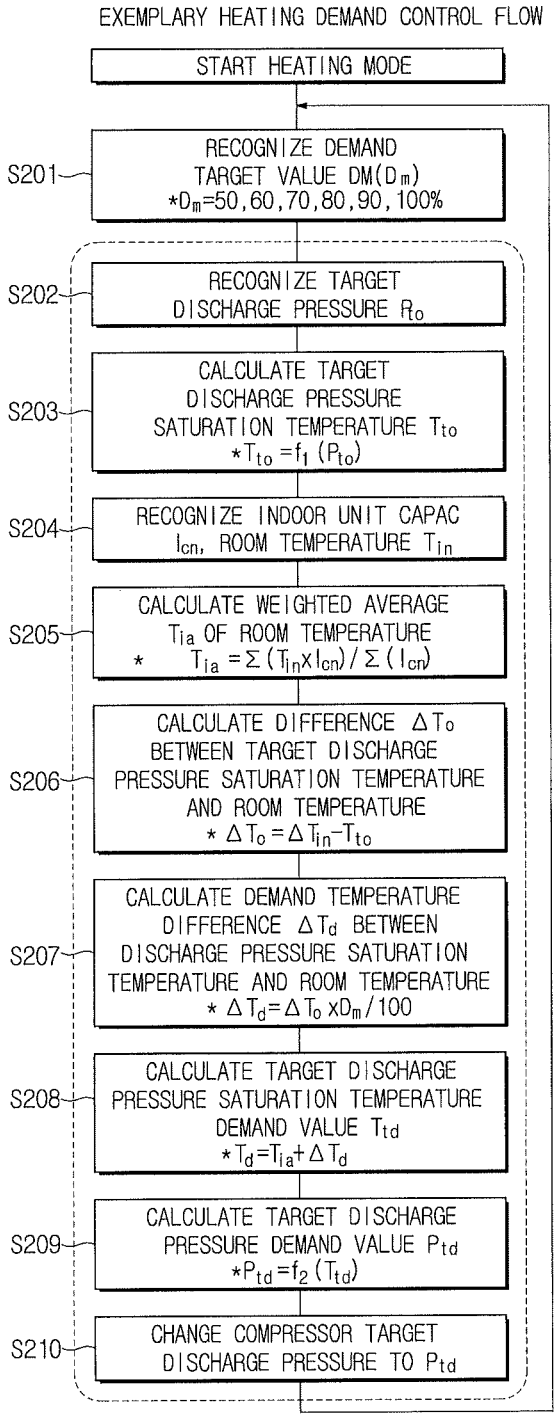
FIG. 4 is a flowchart illustrating an exemplary demand control operation in a heating mode according to an embodiment of the present invention.

FIG. 4 is a flowchart illustrating an exemplary demand control operation in the heating mode. While steps S201 to S210 (except for steps S206 and S208) of the control operation shown in FIG. 4 correspond to steps S1 to S10 of the aforementioned control operation in the cooling mode, the control operation shown in FIG. 4 differs from the control operation shown in FIG. 3 in that the target value in the compressor controller 18 is changed from the normal target discharge pressure Pto to the power reduction target discharge pressure Ptd.

The predetermined target demand amount (target power consumption decrement) Dm is recognized in step S201.

The normal target discharge pressure (normal target pressure) Pto pre-stored in the normal target pressure memory 14 is recognized in step S202.

The normal target discharge pressure Pto is converted into the normal target discharge pressure saturation temperature (normal saturation temperature) Tto using Equation (2) with respect to refrigerant properties in step S203.

Capacity (air-conditioning load) Icn with respect to the indoor unit 100 and the room temperature Tin are recognized in step S204.

Subsequently, the weighted average (mean room temperature) Tia of the room temperature Tin is calculated using Equation (1) in step S205.

The normal temperature difference ΔTo is calculated using Equation (4) in step S206.

The demand temperature difference (temperature difference in case of power reduction) is calculated using Equation (5) in step S207.

The demand saturation temperature (saturation temperature in case of power reduction) Ttd is calculated using Equation (7) in step S208.

The power reduction target discharge pressure Ptd is calculated using Equation (8) in step S209.

The target value in the compressor controller 18 is changed from the normal target discharge pressure Pto to the power reduction target discharge pressure Ptd in step S210. Then, the procedure is returned to step S201.

[Characteristics of the Air Conditioner in the Present Embodiment]

Figure 5:
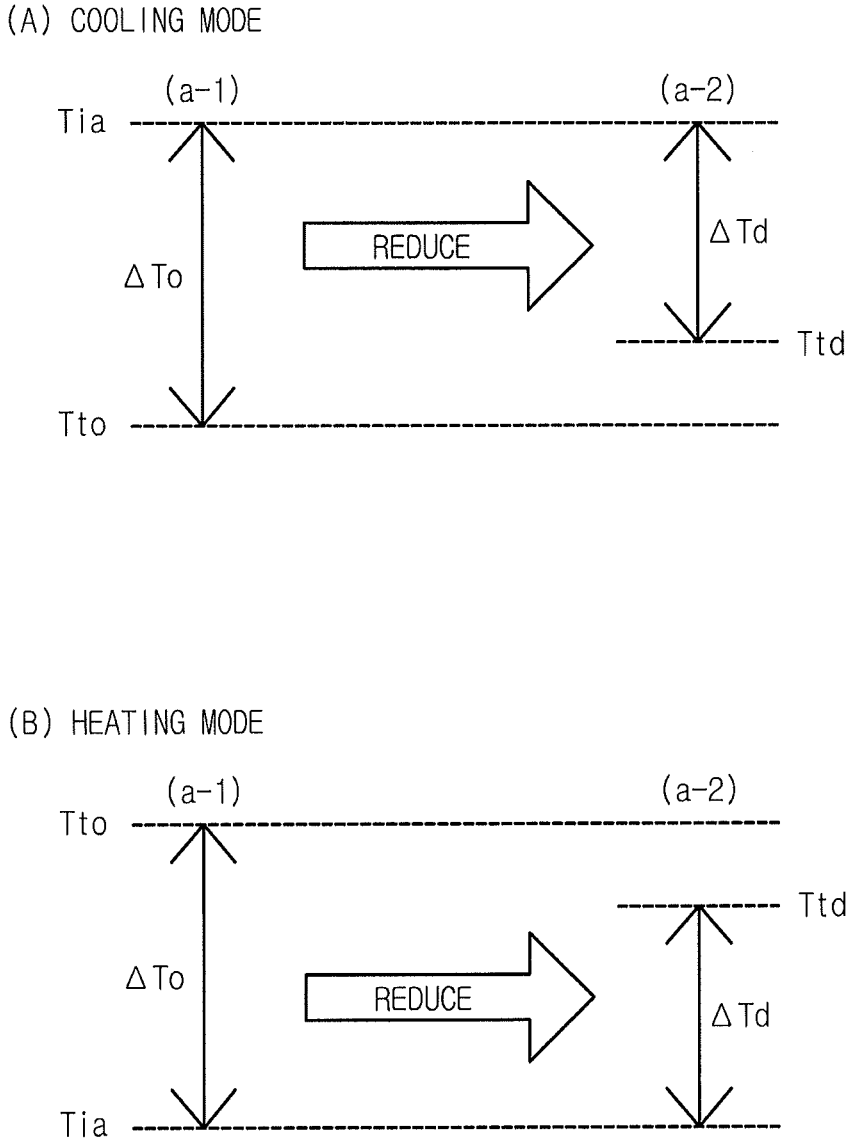
FIG. 5 illustrates a normal temperature difference (To) reduction operation.
Figure 6:
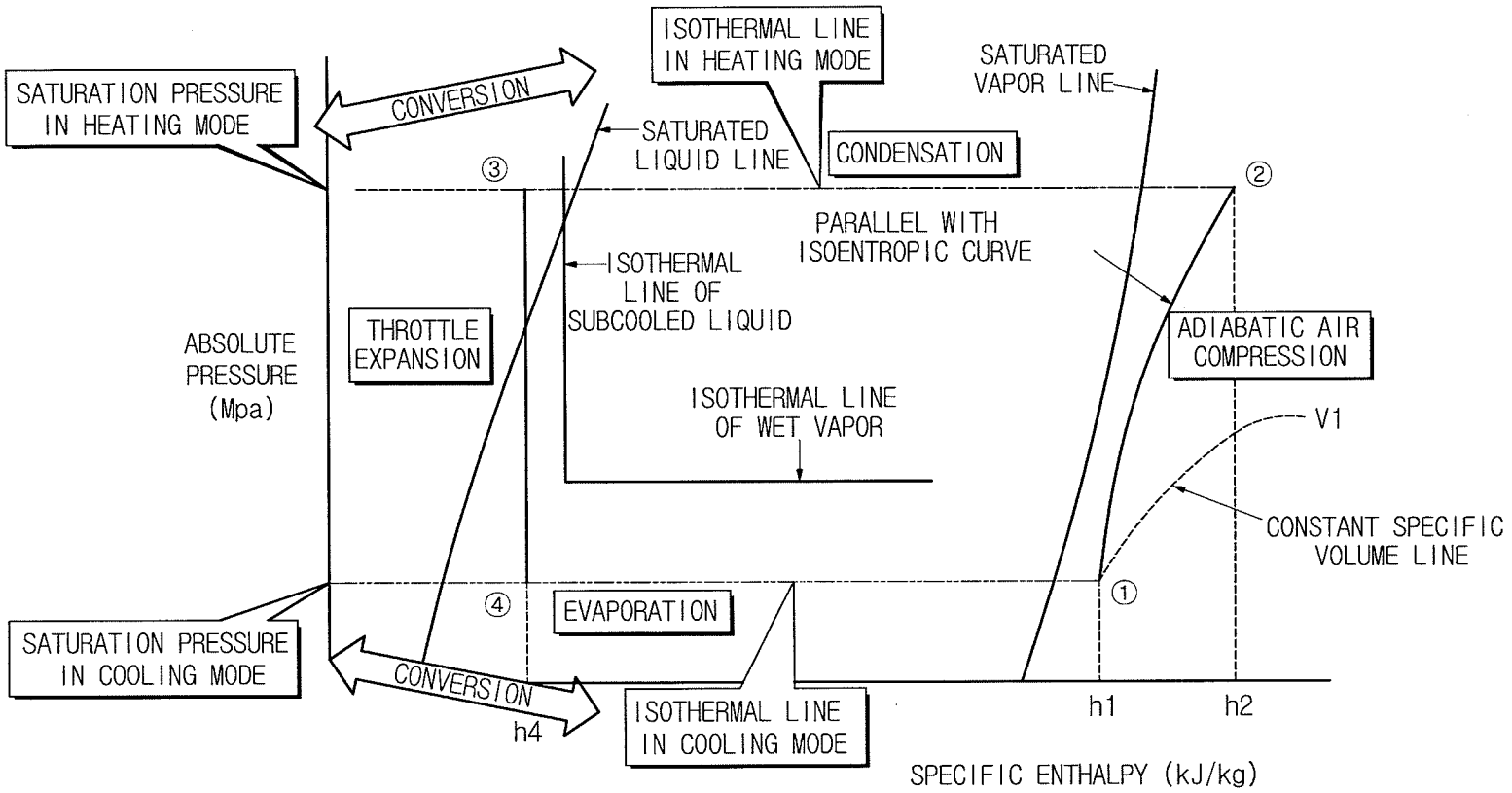
FIG. 6 illustrates an example of the relationship between a saturation pressure and a saturation temperature.

According to the aforementioned configuration, based on the idea that capability of the air conditioner 1 is wasted when user comfort is satisfied as the normal temperature difference ΔTo (a temperature difference between the weighted average Tia and the normal target suction pressure saturation temperature Tto, shown in FIG. 5(*a*-1), or a temperature difference between the normal target suction pressure saturation temperature Tto and the weighted average Tia, shown in FIG. 5(*b*-1)) increases, the normal temperature difference ΔTo based on the target demand amount Dm is reduced in response to the magnitude of the normal temperature difference ΔTo to calculate the demand temperature difference ΔTd as shown in FIG. 5(*a*-2) or 5(*b*-2) and the compressor 5 is controlled using the power reduction target suction pressure Ptd/power reduction target discharge pressure Ptd based on the demand temperature difference ΔTo as a target value, thereby setting the power reduction target suction pressure Ptd/power reduction target discharge pressure Ptd within the range within which user comfort can be maintained while securing power reduction effect at all times, compared to the conventional demand control scheme in which capability of the air conditioner is decreased only when power consumed by the air conditioner exceeds a predetermined threshold. Consequently, it is possible to enable power reduction without damaging user comfort, achieving both user comfort and power reduction.

In addition, according to the aforementioned configuration, optimized power reduction target suction pressure Ptd/power reduction target discharge pressure Ptd can be calculated on the basis of the target demand amount Dm corresponding to a command applied by the user through the remote controller 4. Accordingly, power reduction effect is maximized since optimized power reduction target suction pressure Ptd/power reduction target discharge pressure Ptd corresponding to indoor air-conditioning load can be obtained. For example, when demand control is performed in the cooling mode, high suction pressure can be set, compared to the conventional demand control. More specifically, when the suction pressure can be increased by 0.06 MPa, power reduction effect can be improved 6% approximately, compared to the conventional demand control.

Furthermore, according to the aforementioned configuration, since the demand control according to the present invention is based on the normal target pressure (normal target suction pressure Pto/normal target discharge pressure Pto) which is set as a target value in normal control operation of the compressor controller 18 and is in relation with the outdoor temperature and indoor air-conditioning load, power reduction effect can be obtained all the times even when user environment conditions are changed. For example, when demand control is performed in the cooling mode, suction pressure can be varied according to outdoor temperature variation. More specifically, when the outdoor temperature decreases by 1° C., power reduction can be improved 2% approximately, compared to the conventional demand control.

Moreover, according to the above-described configuration, since the normal temperature difference ΔTo is reduced by multiplying the normal temperature difference ΔTo by the power reduction coefficient (target demand amount Dm/100), power consumption can be highly accurately set according to user demands. In addition, it is possible to prevent deterioration of user comfort due to an excessive target demand amount increase which is estimated during conventional demand control.

Furthermore, according to the aforementioned configuration, when the normal temperature difference ΔTo is reduced, the target demand amount Dm can be set to 50, 60, 70, 80, 90 and 100 according to manipulation of the remote controller 4 by the user. In addition, since the power reduction coefficient (target demand amount Dm/100) can be set to a large value when user comfort is prioritized and set to a small value when power reduction is prioritized, demand control level can be adjusted according to the purpose of a building in which the air conditioner 1 is installed or user demands. Accordingly, it is possible to prevent deterioration of user comfort estimated during conventional demand control or a claim made by the user caused by insufficient power reduction.

In addition, according to the above-described configuration, a value obtained by subtracting a predetermined value from the weighted average Tia can be set to the upper limit of the demand saturation temperature Ttd in the cooling mode, whereas a value obtained by adding the predetermined value to the weighted average Tia can be set to the lower limit of the demand saturation temperature Ttd in the heating mode and thus it is possible to prevent lack of cooling/heating performance due to insufficient capability of the indoor heat exchanger 3. For example, when the demand saturation temperature Ttd is increased by 1° C. by setting the lower limit thereof during demand control in the cooling mode, cooling performance deterioration of approximately 5% can be prevented compared to conventional demand control.

Moreover, according to the aforementioned configuration, since the predetermined value can be set to a value in the range of 3° C. to 10° C., it is possible to prevent poor heat exchange in the indoor unit and comfort deterioration due to insufficient temperature difference between the air and refrigerant, which is estimated in the conventional demand control operation. In addition, it is possible to prevent power reduction effect from being deteriorated due to unnecessary demand saturation temperature restriction.

While the embodiments of the present invention have been described with reference to the attached drawings, detailed configurations are not limited to the aforementioned embodiments. The scope of the present invention is defined by the appended claims as well as the above-described embodiments and includes equivalents and modifications falling within the scope of the appended claims.

Furthermore, while the compressor controller 18 calculates the power reduction target suction pressure Ptd/power reduction target discharge pressure Ptd by inputting the demand saturation temperature Ttd to Equation (8) in the above-described embodiment, the present invention is not limited thereto and the power reduction target suction pressure Ptd/power reduction target discharge pressure Ptd may be obtained based on outputs of suction/discharge pipe thermistors for detecting intake/discharge refrigerant temperatures in a suction pipe/discharge pipe of the compressor 5 Similarly, the compressor controller 18 can obtain the normal target suction pressure Pto/normal target discharge pressure Pto based on the outputs of the suction/discharge pipe thermistors. In addition, the compressor controller 18 can obtain the power reduction target suction pressure Ptd/power reduction target discharge pressure Ptd or the normal target suction pressure Pto/normal target discharge pressure Pto based on a command value from the control unit 12.

While the normal temperature difference computation unit 15 converts the normal target pressure (normal target suction pressure Pto/normal target discharge pressure Pto) into the normal saturation temperature (normal target suction pressure saturation temperature Tto/normal target discharge pressure saturation temperature Tto) using Equation (2) with respect to refrigerant properties in the aforementioned embodiment, the present invention is not limited thereto and the normal target pressure (normal target suction pressure Pto/normal target discharge pressure Pto) can be converted into the normal saturation temperature (normal target suction pressure saturation temperature Tto/normal target discharge pressure saturation temperature Tto) with reference to a refrigerant property table (look-up table)

storing refrigerant properties. Otherwise, the present invention can convert the normal target pressure (normal target suction pressure Pto/normal target discharge pressure Pto) into the normal saturation temperature (normal target suction pressure saturation temperature Tto/normal target discharge pressure saturation temperature Tto) on the basis of the corresponding relationship between saturation pressure and saturation temperature of the refrigerant.

INDUSTRIAL APPLICABILITY

According to the present invention, it is possible to provide an air conditioner capable of achieving both user comfort and power reduction.

The invention claimed is:

1. An air conditioner including an indoor portion of the air conditioner and an outdoor portion of the air conditioner, comprising:

a mean room temperature sensor inducting a room temperature sensor to determine a mean room temperature of an indoor space in which the indoor portion of the air conditioner is installed;

a compressor contained in the outdoor portion of the air conditioner;

a compressor controller to control the compressor such that a pressure of a refrigerant discharged from the compressor or the pressure of a refrigerant sucked into the compressor becomes a target pressure value;

a normal target pressure memory storing a normal target pressure set to a target value during normal control operation of the compressor controller and related with the outdoor temperature and air-conditioning load of the indoor space;

a normal temperature difference processor to calculate a temperature difference between a normal saturation temperature corresponding to the normal target pressure and the mean room temperature as a normal temperature difference; and a power reduction temperature difference processor to calculate a power reduction temperature difference reduced from the normal temperature difference on the basis of a target power consumption decrement with respect to power consumption during normal control of the air conditioner, wherein the compressor controller is configured to control the compressor by changing a power reduction target pressure, which is a saturation pressure corresponding to a power reduction saturation temperature calculated on a basis of the mean room temperature and the power reduction temperature difference, to the target value.

2. The air conditioner according to claim 1, wherein the power reduction temperature difference processor calculates the power reduction temperature difference by multiplying the normal temperature difference by a power reduction coefficient based on the target power consumption decrement.

3. The air conditioner according to claim 1, further comprising a target power consumption decrement change processor to change the target power consumption decrement according to operation of a user.

4. The air conditioner according to claim 1, wherein the compressor controller comprises a power reduction saturation temperature setting processor to set a value obtained by subtracting a predetermined value from the mean room temperature to an upper limit of the power reduction saturation temperature in a cooling mode of the air conditioner and setting a value obtained by adding the predetermined value to the mean room temperature to a lower limit of the power reduction saturation temperature in a heating mode of the air conditioner.

5. The air conditioner according to claim 4, wherein the power reduction saturation temperature setting processor sets the predetermined value to a value in a range of 3°C. to 10°C.

* * * * *